US006659790B1

(12) United States Patent
Wu

(10) Patent No.: US 6,659,790 B1
(45) Date of Patent: Dec. 9, 2003

(54) ELECTRICAL CONNECTOR HAVING IMPROVED PULL TAB

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/245,188

(22) Filed: Sep. 16, 2002

Related U.S. Application Data

(63) Continuation-in-part of application No. 10/209,553, filed on Jul. 30, 2002.

(51) Int. Cl.[7] ..... H01R 13/627
(52) U.S. Cl. ..... 439/352; 439/357
(58) Field of Search ..... 439/352, 350, 439/351, 353–358, 372, 607, 610

(56) References Cited

U.S. PATENT DOCUMENTS 3,548,455 A * 12/1970 Ezure ..... 425/352
4,634,204 A * 1/1987 Detter et al. ..... 439/347
5,564,939 A 10/1996 Maitani et al.
5,634,809 A * 6/1997 Hirai ..... 439/352
5,951,316 A * 9/1999 Kawano et al. ..... 439/352
6,394,842 B1 * 5/2002 Sakurai et al. ..... 439/607

* cited by examiner

*Primary Examiner*—Hien Vu
(74) *Attorney, Agent, or Firm*—Wei Te Chung

(57) ABSTRACT

An electrical connector (1) formating with a complementary connector includes a main housing, a terminal insert (60), a pull tab (80) and a pair of latch springs (70). The main housing includes a bottom housing (10) and a top housing (20)assembled onto the bottom housing, a mating frame (13) formed on a front end thereof. The terminal insert is assembled into the mating frame and has a plurality of terminals (64) received therein. The pull tab (80) received in the connector has an operation portion (81) and a pair of latch releasing portions (83) at a free end thereof. The latch springs (70) cooperates with the pull tab. When the connector is mated with the complementary connector, the operation portion abuts against a surface of the main housing; when the pull tab is pulled rearwardly by gripping the operation portion in a longitudinal direction, the latch releasing portions deflect the latch springs in a lateral direction for separating from a hook of the complementary connector, thereby the connector is released.

9 Claims, 8 Drawing Sheets

ELECTRICAL CONNECTOR HAVING IMPROVED PULL TAB

CROSS-REFERENCES TO RELATED APPLICATIONS

The present application is a continuation-in-part of U.S. patent application Ser. No. 10/209,553 filed on Jul. 30, 2002 and entitled "ELECTRICAL CONNECTOR HAVING A LATCH MECHANISM", and the content of which is incorporated herein by reference now.

BACKGROUND OF THE INVENTION

1. Field of the Invention

The present invention relates to an electrical connector, and particularly to an electrical connector having latch springs for engaging with and releasing from a mated complementary connector.

2. Description of Prior Art

Referring to U.S. Pat. No. 5,564,939 issued on Oct. 15, 1996 to Maitani, et al. A conventional electrical connector disclosed in the patent has a pair of latch springs 22 and 22A respectively attached on opposite sides of a housing 21 of the connector. An operating member 23 has a pair of latch releasing cams 23-4 located below angled portions 22-4 of the latch springs 22, 22A. When an operator pulls a pull tab 23-8 of the operating member 23 backwardly, the latch releasing cams 23-4 exert outward forces on the angled portions 22-4 and U-shaped claws 22-1 slip out to release a mated complementary connector. Because the operating member 23 is positioned outside of the housing 21, they are very easy to be damaged when a force is exerted thereon. When two or more such connectors are arranged, a relatively large space is needed between every two connectors and this adversely affects the compact design of an electronic system including such connectors. To overcome the above mentioned disadvantages, an electrical connector is needed which has a pull tab which will not increase the length of the connector, and a better protection is provided to the pull tab to prevent them from damage by an external force.

SUMMARY OF THE INVENTION

It is an objective of the present invention to provide an electrical connector having a pull tab assembled therein for engaging with and releasing from a mated complementary connector; the pull tab will not increase the length of the connector and it is protected from an external force to act thereon whereby a damage of the pull tab by the external force can be prevented.

In order to achieve the object above-mentioned, an electrical connector for mating with a complementary connector includes a main housing, a terminal insert, a pull tab and a pair of latch springs. The main housing includes a bottom housing and a top housing assembled onto the bottom housing, a mating frame formed on a front end thereof. The terminal insert is assembled into the mating frame and has a plurality of terminals received therein. The pull tab received in the connector has an operation portion and a pair of latch releasing portions at a free end thereof. The latch springs cooperates with the pull tab. When the connector is mated with the complementary connector, the operation portion abuts against a surface of the main housing; when the pull tab is pulled rearwardly by gripping the operation portion in a longitudinal direction, the latch releasing portions deflect the latch springs in a lateral direction for separating from a hook of the complementary connector, thereby the connector is released.

Other objects, advantages and novel features of the invention will become more apparent from the following detailed description when taken in conjunction with the accompanying drawings.

DETAILED DESCRIPTION OF THE INVENTION

Figure 1:
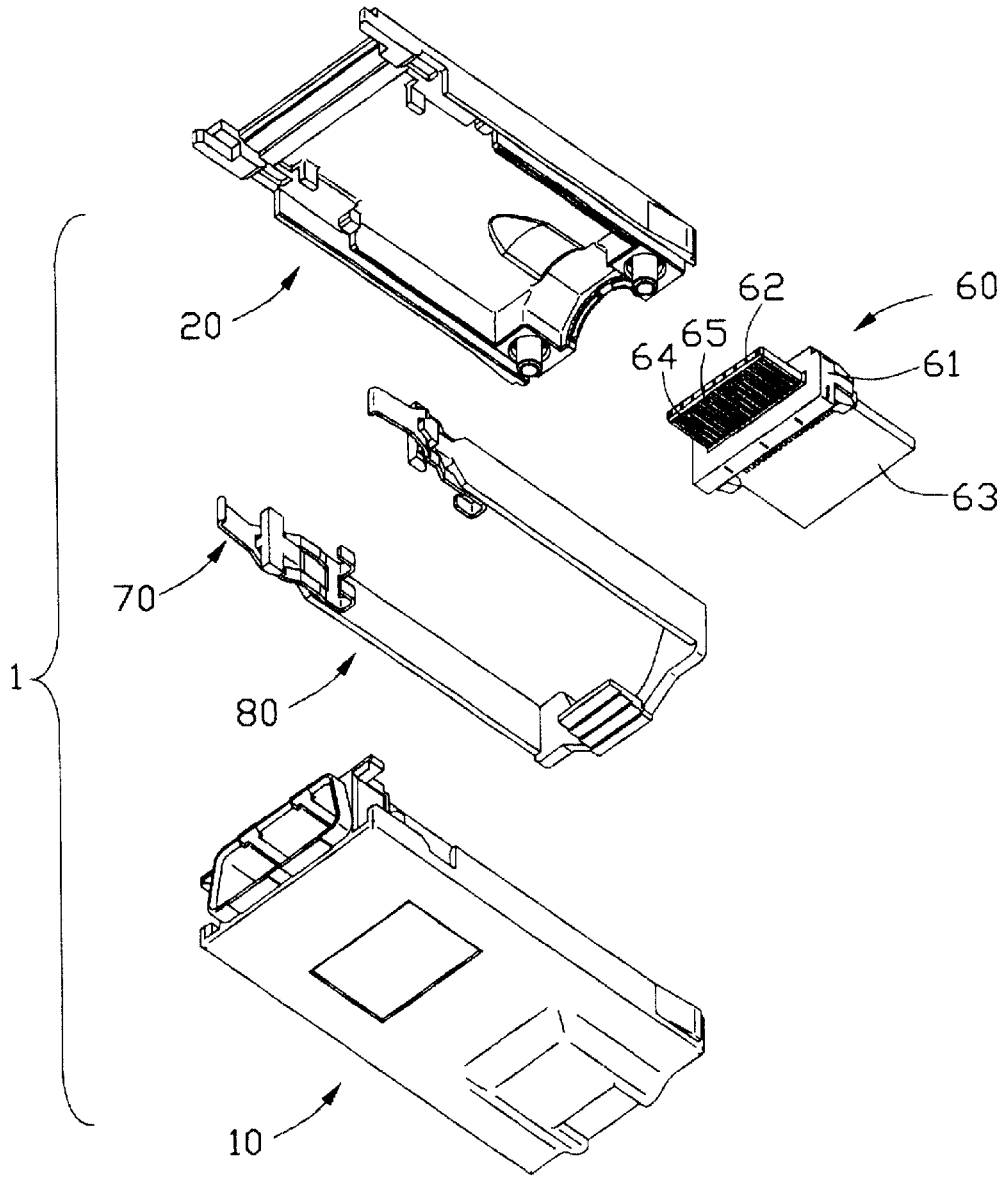
FIG. 1 is an exploded perspective view of an electrical connector in accordance with the present invention.

Referring to FIG. 1, an electrical connector 1 in accordance with the present invention comprises a main housing which comprises a bottom housing 10 and a top housing 20 for being assembled to the bottom housing 10, a terminal insert 60, a pair of latch springs 70, and a pull tab 80.

Figure 2:
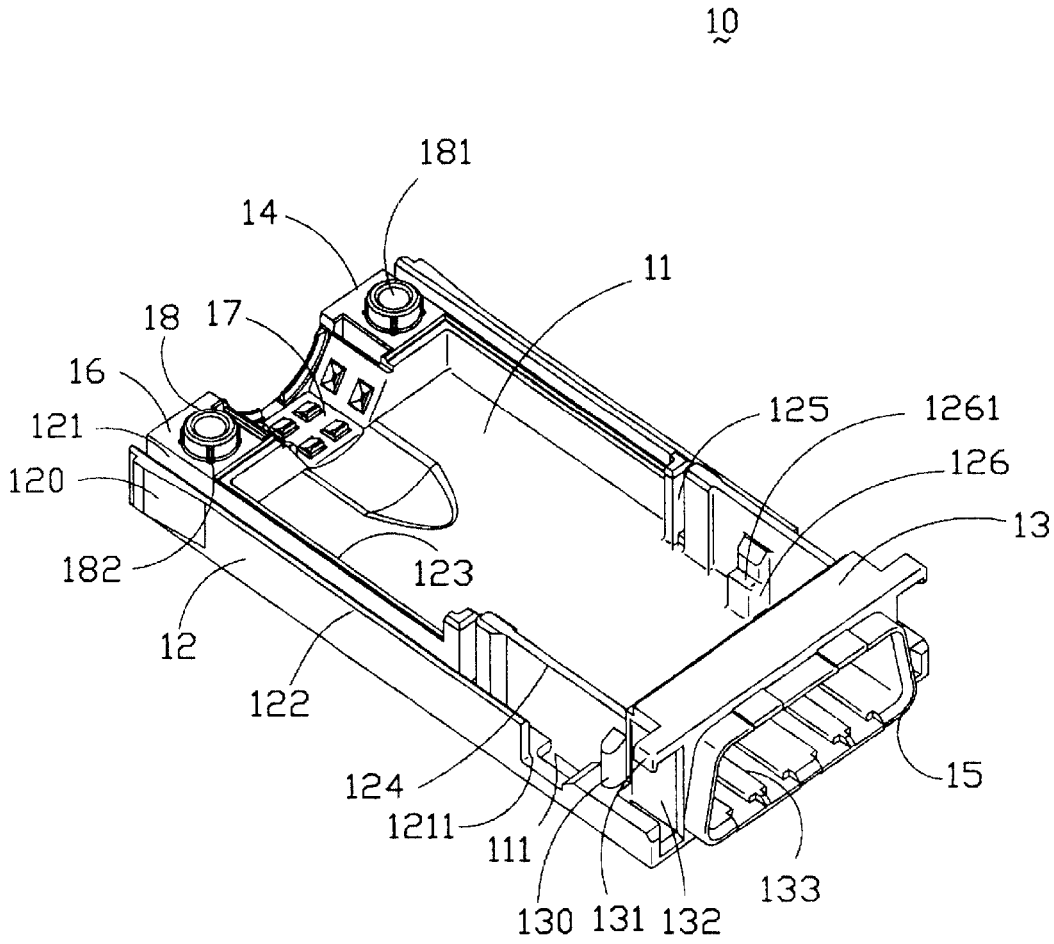
FIG. 2 is an enlarged-perspective view of a bottom housing shown in FIG. 1.
Figure 3:
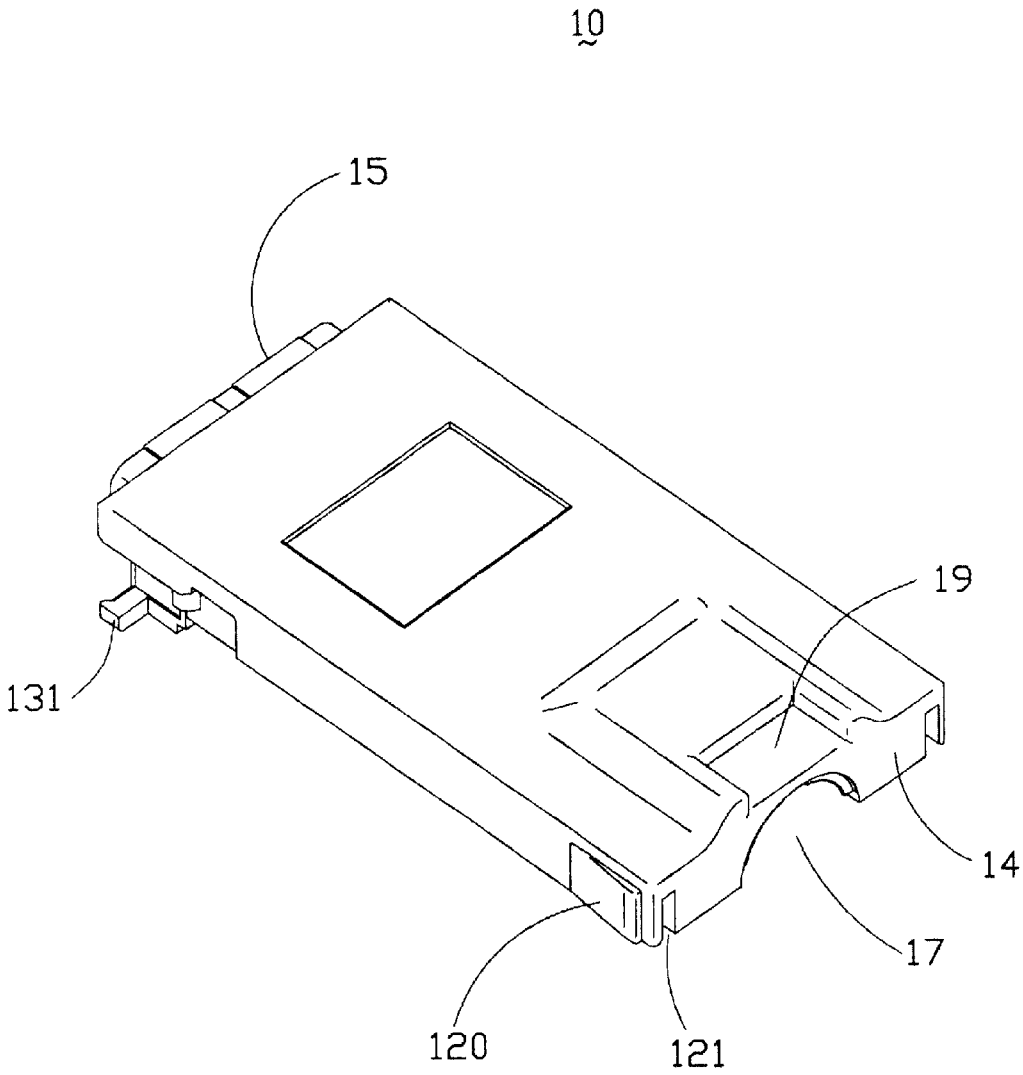
FIG. 3 is an enlarged perspective view of a bottom housing shown in FIG. 1 from a bottom aspect.

The bottom housing 10 and the top housing 20 are formed by die casting metallic material, for example, aluminum alloy. Referring to FIG. 2, the bottom housing 10 comprises a base plate 11 and a pair of sidewalls 12 upwardly extending from opposite lateral sides of the base plate 11. Each sidewall 12 defines an elongated channel 121 from a rear end 14 toward a front end 15 of the bottom housing 10 and through a top engaging face 16 thereof. Each sidewall 12 is divided into an outer wall 122 and an inner wall 123 by the channel 121. The outer wall 122 has an inclined protrusion 120 formed on an outer surface thereof. The inner walls 123 each have a higher shoulder portion 124 adjacent to the front end 15. The shoulder portions 124 each define a vertical slit 125 at a rear end thereof. The outer walls 122 each define a cutout 1211 adjacent to the front end 15. A pair of blocks 126 is formed on inner sides of the shoulder portions 124 of the inner walls 123. Each block 126 defines a step portion 1261. The base plate 11 defines a pair of grooves 111 each being located between the shoulder portion 124 of a corresponding inner wall 123 and a corresponding cutout 1211. A mating frame 13 is formed at the front end 15 of the bottom housing 10. The mating frame 13 defines an opening 133 through the front end 15. A pair of engaging ears 131 is formed on opposite sides of a top of the mating frame 13 and extends laterally. A pair of engaging spaces 132 is defined in opposite sides of the mating frame 13 and between the engaging ears 131 and the base plate 11. A pair of bars 130 projects sideward from the shoulder portion 124 adjacent to the mating frame 13. The bottom housing 10 has a first substantially semicircular opening 17 at the rear end 14. A pair of posts 18 protrudes upwardly from the engaging face 16, located respectively at opposite sides of the first opening 17. Each post 18 defines a screw hole 181 therein and has four ribs 182 on a circumferential periphery thereof. A recess 19 (shown in FIG. 3) is defined in a bottom face of the bottom housing 10 adjacent to the rear end 14.

Figure 4:
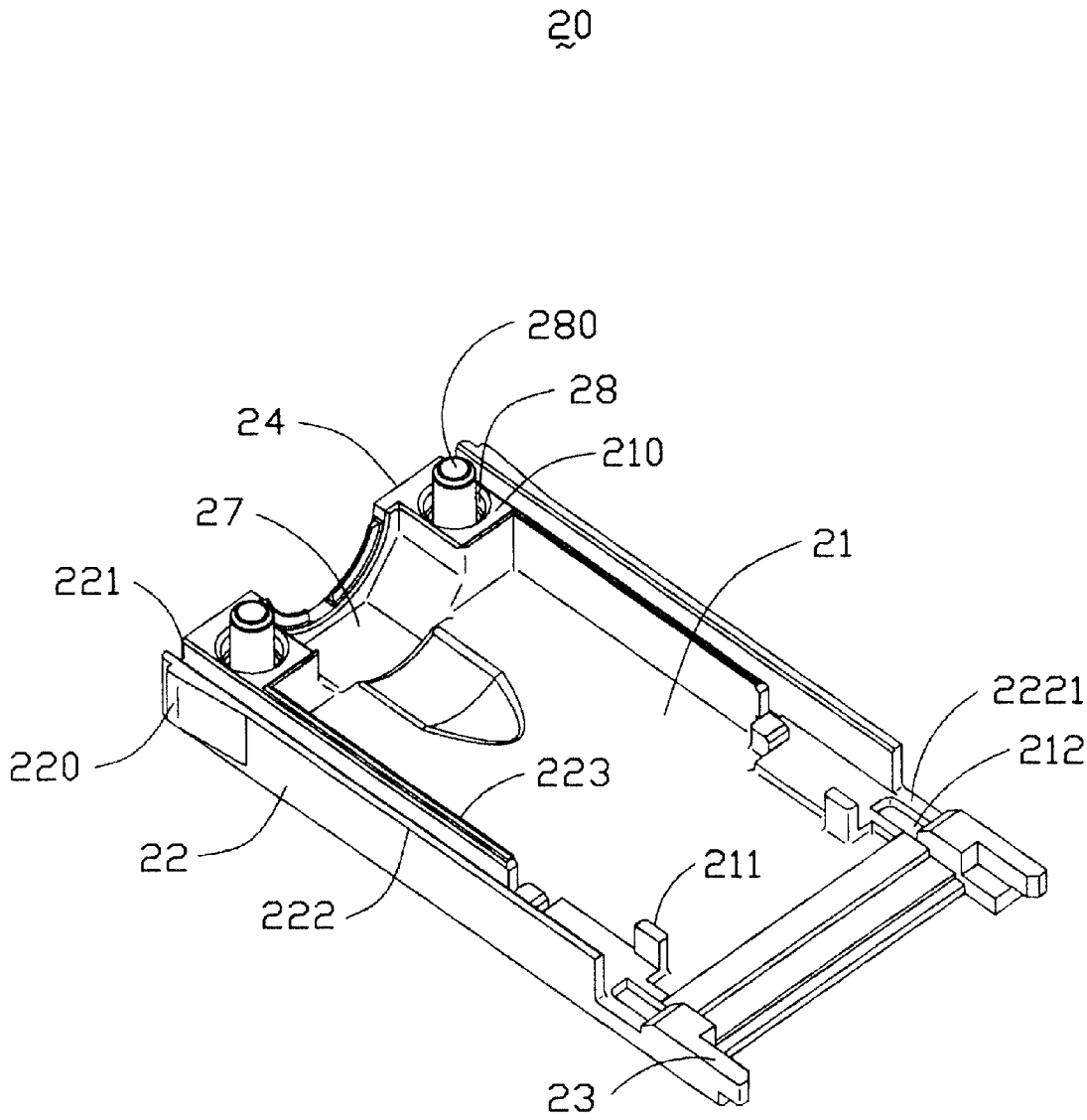
FIG. 4 is an enlarged perspective view of a top housing shown in FIG. 1.

Referring to FIG. 4, the top housing 20 comprises a top housing plate 21 and a pair of sidewalls 22 downwardly extending from opposite lateral sides of the top housing plate 21. Each sidewall 22 defines an elongated channel 221 corresponding to the channel 121 of the bottom housing 10. Each sidewall 22 is divided into an outer wall 222 and an inner wall 223 by the channel 221. The outer wall 222 has an inclined protrusion 220 formed on outer surface thereof corresponding to the inclined protrusion 120. A pair of blocks 211 extends downwardly from the top housing plate 21 corresponding to the blocks 126. A pair of grooves 212, corresponding to the grooves 111 in the bottom housing 10, is defined in the top housing plate 21 in inner sides of a pair of cutouts 2221 which is corresponding to the cutouts 1211 in the bottom housing 10. A pair of projections 23 extends forwardly from opposite sides of a front end the top housing plate 21. A semicircular second opening 27 is defined in a rear end 24 of the top housing plate 21 corresponding to the first opening 17 of the bottom housing 10. A pair of holes 28 is defined in opposite sides of the second opening 27. Each hole 28 has a diameter generally equal to an outer diameter of each of the posts 18.

Figure 5:
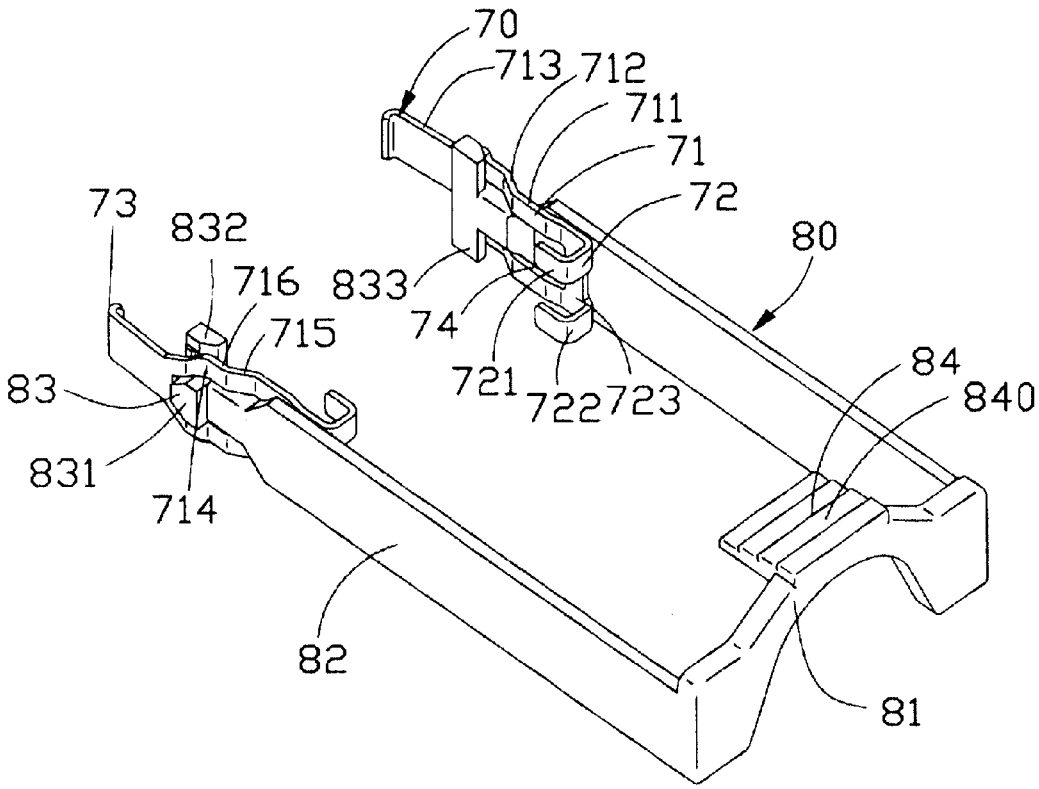
FIG. 5 is an enlarged perspective view of latch springs and a pull tab shown in FIG. 1.

Referring to FIG. 5, each of the latch springs 70 is formed by stamping a metal sheet and has a body portion 71, a U-shaped claw portion 72 formed at a rear end of the body portion 71, and an L-shaped claw portion 73 formed at a front end of the body portion 71. An elongated cutout 74 is defined in the body portion 71 in a front to rear direction. The body portion 71 comprises a rear portion 711, a middle portion 712, and a front portion 713 extending parallelly to the rear portion 711 from the middle portion 712. The middle portion 712 comprises a front slope portion 714, a rear slope portion 715, and an intermediate portion 716 between the front and rear slope portions 714, 715.

The pull tab 80 comprises an operation portion 81, a pair of arms 82 extending forwardly from opposite sides of the operation portion 81, and a pair of latch releasing portion 83 formed at front ends of the arms 82, respectively. The operation portion 81 comprises an operating tongue 84 projecting forwardly from the operation portion 81 corresponding to the recess 19. A plurality of steppers 840 are formed on the operating tongue 84. Each latch releasing portion 83 has upper and lower tip ends 832, 833, and a protrusion 831 protruding outwardly from an outside face thereof.

Referring to FIG. 1, the terminal insert 60 comprises an insulating body 61, a tongue portion 62 extending forwardly from the body 61, a printed circuit board (PCB) 63 assembled to a rear side of the body 61. A plurality of passageways 65 are defined in upper and lower surfaces of the tongue portion 62. A plurality of terminals 64 are received in the passageways 65 of the tongue portion 62 and extend through the body 61 to electrically connect the PCB 63.

Figure 6:
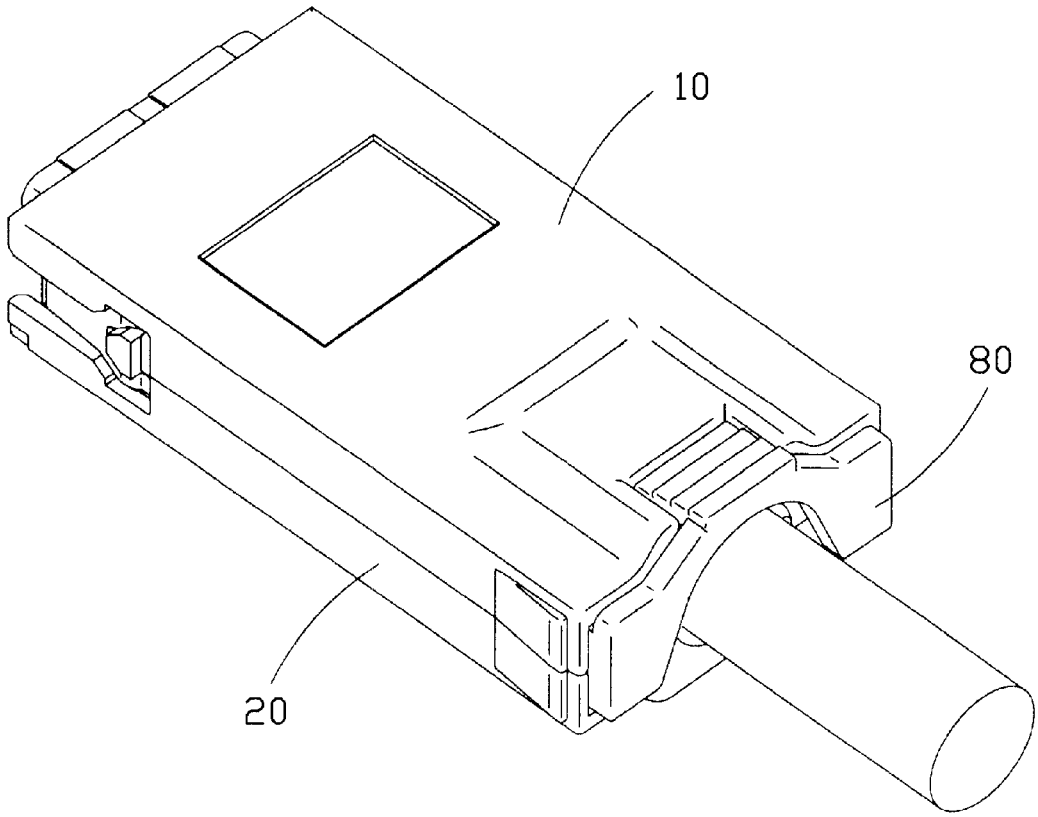
FIG. 6 is an assembled view of the electrical connector shown in FIG. 1 with a cable end.
Figure 7:
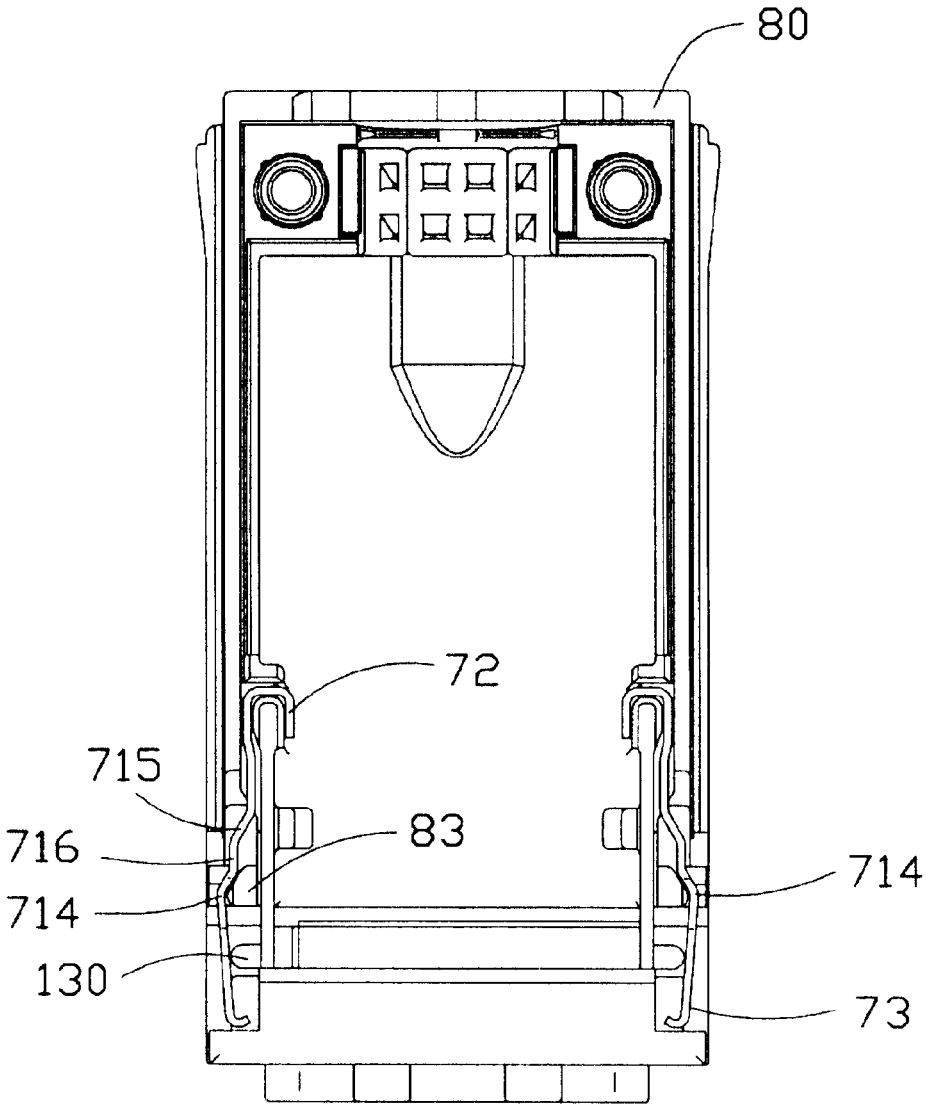
FIG. 7 is a top planar view of the electrical connector in FIG. 6, wherein the top housing and the cable end of the electrical connector are removed, and latch springs are located at a close position.

Referring to FIGS. 5–7 in conjunction with FIGS. 1–2, in assembly, the terminal insert 60 is assembled to the bottom housing 10 with the tongue portion 62 received in the opening 133. The PCB 63 is received in the bottom housing 10 between the two sidewalls 12 and positioned upon the step portions 1261 of the blocks 126. The two latch springs 70 are respectively assembled to the pull tab 80 by extending the protrusions 831 into the cutouts 74 from inner faces of the latch springs 70, whereby the latch releasing portions engage with the inner faces of the latch springs 70, respectively. The latch releasing portions 83 are positioned at the inner faces of the front portions 713 and the protrusions 831 are fitted into front portions of the cutouts 74. Then, the latch springs 70 together with the pull tab 80 are assembled to the bottom housing 10. The arms 82 are placed into the channels 121 and the operating tongue 84 of the pull tab 80 is received in the recess 19 with the operation portion 81 abutting against the rear end 14 of the bottom housing 10. The U-shaped claw portions 72 are received into the slits 125 and engaged with rear ends of the shoulder portions 124 to secure the latch springs 70 to the bottom housing 10. The PCB 63 is located in the gap 723 between the upper and lower U-shaped claw portions 721, 722. The lower tip ends 833 of the latch releasing portions 83 are placed in the grooves 111 with the protrusions 831 extending into the cutouts 1211. The L-shaped claw portions 73 extend into the engaging spaces 132 for latching with a complementary connector (not shown). The top housing 20 is assembled to the bottom housing 10 by placing the projections 23 beneath the pair of engaging ears 131. Then a rear portion of the top housing 20 is rotated downwardly about the pair of engaging ears 131 until a bottom face of the top housing 20 intimately abuts the top engaging face 16 of the bottom housing 10. Upper portions of the arms 82 are received in the channels 221 and the upper tip ends 832 of the latch releasing portions 83 are received into the grooves 212 of the top housing 20. The blocks 211 abut a top face of the PCB 63 above the step portions 1261 of the blocks 126 to secure the PCB 63 in position. The posts 18 are received into the holes 28 with the four ribs 182 engaging with inner surfaces of the holes 28. The first and second openings 17 and 27 together form a cable receiving opening for extension of a cable (shown in FIG. 6) therethrough. Finally, a pair of screws (not shown) are screwed into the screw holes 181 to securely fasten the top housing 20 and the bottom housing 10 together, whereby the electrical connector 1 in accordance with the present invention is obtained.

An operation of the electrical connector 1 in introduced below.

Figure 8:
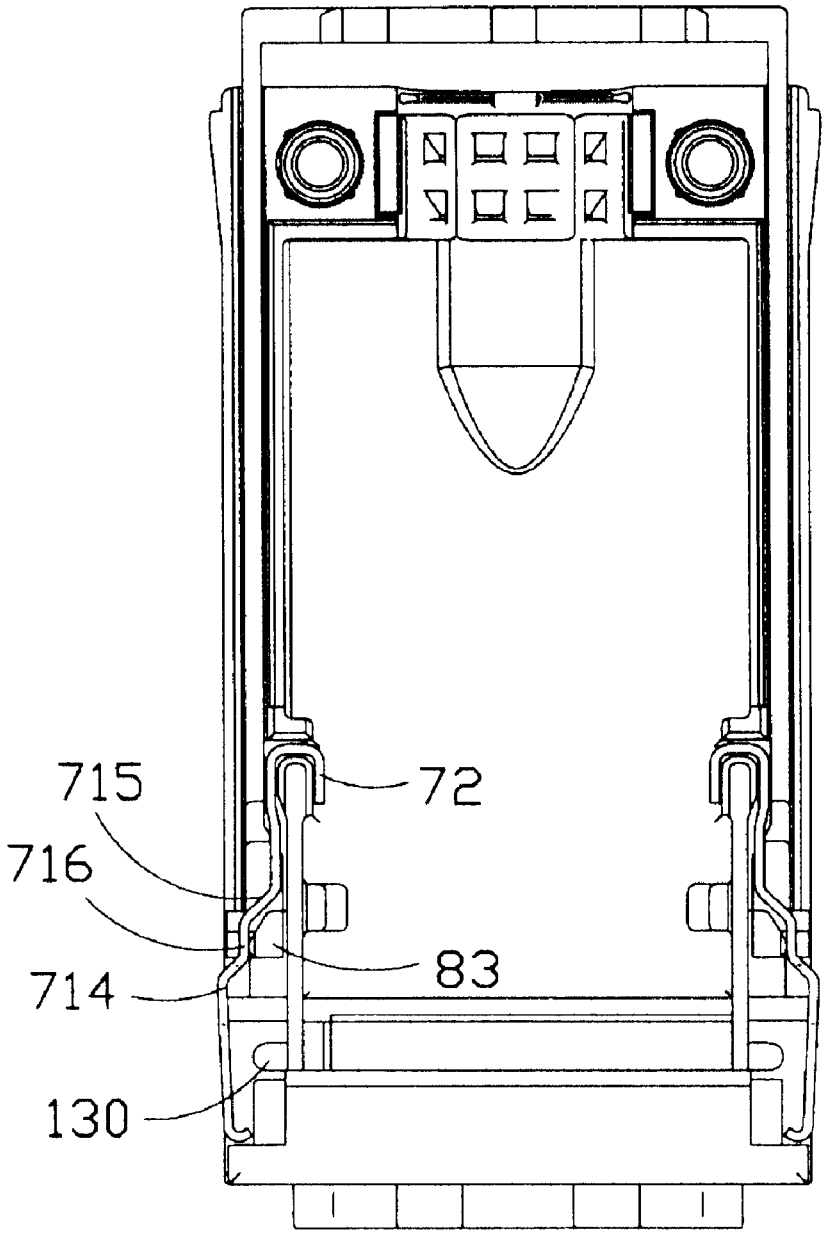
FIG. 8 is a view similar to FIG. 7, except that latch springs are moved to an open position.

Referring to FIGS. 7 and 8, when the complementary connector is mated with the electrical connector 1 of the present invention, the bars 130 engaging with inner faces of the front portions 713 and the L-shaped claw portions 73 engage with corresponding hooks of the complementary connector. The electrical connector 1 is unmated with the complementary connector by the following operation. An operator grips the operation portion 81 of the pull tab 80 and pulls it rearwardly in a longitudinal direction, the upper and lower tip ends 832, 833 slide in the grooves 111, 212 and the protrusions 831 slide in the cutouts 74, and the bars 130 separate from inner sides of the front portions 713. When the latch releasing portions 83 come into contact with the front slope portions 714, they exert an outward force on inner faces of the front slope portions 714. The latch springs 70 are elastically deformed and the front portion 713 is pushed out. Thus, the L-shaped claw portions 73 are driven to move out of the engaging portions of the complementary connector. When the latch releasing portions 83 slide on the intermediate portions 716, the intermediate portions 716 have an inward force exerted on the latch releasing portions 83 in a lateral direction vertical to the mating direction. When the operator exerts a rearward force to the inclined protrusions 120, 220, the connector 1 is pulled rearward until the connector 1 separates from the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector comprising;

a main housing comprising a bottom housing and a top housing assembled onto the bottom housing, a mating frame formed on a front end thereof;

a terminal insert assembled into the mating frame and having a plurality of terminals received therein;

a pull tab securely attaching to the housing and having an operation portion at one end thereof and a latch releasing portion at the other end thereof; and a pair of latch springs cooperating with the pull tab for engaging with a hook of the complementary connector;

wherein when the connector is mated with the complementary connector, the operation portion abuts against a surface of the main housing; when the pull tab is pulled rearwardly in a longitudinal direction by gripping the operation portion, the latch releasing portions deflect the latch springs in a lateral direction for separating from the hook of the complementary connector, thereby the connector is released; wherein the operation of the pull tab comprises an operating tongue, and the bottom housing defines a recess in a bottom face for receiving the operating tongue; wherein the main housing defines a pair of channels on opposite sides thereof, and the pull tab comprises a pair of arms extending from opposite ends of the operating portion for being received in the channels, respectively; wherein the operating, tongue comprises a plurality of steppers thereon for providing more roughness to facilitate an operator easily to operate the pull tab; where in the main housing comprises a pair of bars adjacent to corresponding sides of the mating frame.

2. The electrical connector as described in claim 1, wherein when the connector mates with the complementary connector, the bars are engaging with the latch springs.

3. The electrical connector as described in claim 2, wherein when the pull tab is pulled rearwardly, the bars are separated from the latch springs.

4. The electrical connector as described in claim 1, wherein each latch spring has a first claw portion engaging with the bottom housing, a second claw portion adapted for securely engaging with the complementary connector when said complementary connector mates with the electrical connector, and a sloping portion between the first and second claw portions and engaging with a corresponding latch releasing portion of the pull tab.

5. The electrical connector as described in claim 4, wherein each latch spring defines a cutout in the sloping portion, the latch releasing portion having a protrusion extending into the cutout from an inner face to an outer face of the sloping portion, so that the latch releasing portion contacts with the inner face of the sloping portion of the latch spring.

6. The electrical connector as described in claim 5, wherein the protrusion protrudes outwardly from an outside face of the latch releasing portion.

7. The electrical connector as described in claim 6, wherein the latch releasing portion has upper and lower tip ends, the top housing and the bottom housing each defines a groove receiving the upper and lower tip ends of the latch releasing portion therein, the tip ends sliding rearwardly in the grooves when the pull tab is pulled rearwardly.

8. The electrical connector as described in claim 1, wherein the main housing comprises roughness means for facilitating to pull or push the connector.

9. The electrical connector as described in claim 8, wherein the roughness means comprises an incline protrusion formed on an outer surface of the main housing.

* * * * *